US012371912B2

(12) United States Patent
Kain

(10) Patent No.: US 12,371,912 B2
(45) Date of Patent: Jul. 29, 2025

(54) SYSTEM AND METHOD FOR SUPPORTING WORKERS AND MATERIAL ON A SLOPED ROOF

(71) Applicant: William Webster Kain, Montpelier, VA (US)

(72) Inventor: William Webster Kain, Montpelier, VA (US)

( * ) Notice: Subject to any disclaimer, the term of this patent is extended or adjusted under 35 U.S.C. 154(b) by 1025 days.

(21) Appl. No.: 17/397,476

(22) Filed: Aug. 9, 2021

(65) Prior Publication Data

US 2022/0056714 A1 Feb. 24, 2022

Related U.S. Application Data

(60) Provisional application No. 63/159,639, filed on Mar. 11, 2021, provisional application No. 63/067,827, filed on Aug. 19, 2020.

(51) Int. Cl.
*E04G 3/26* (2006.01)

(52) U.S. Cl.
CPC ..... *E04G 3/26* (2013.01)

(58) Field of Classification Search
CPC ..... E04G 3/26; E04G 3/265; E04G 5/041; E04G 21/3276
See application file for complete search history.

(56) References Cited

U.S. PATENT DOCUMENTS 95,519 A 10/1869 Ross
909,012 A * 1/1909 McCarty ..... E04G 3/26 248/237
1,133,878 A * 3/1915 Nagel ..... E04G 3/26 248/237
1,152,685 A 9/1915 Winn
(Continued)

FOREIGN PATENT DOCUMENTS

GB 2201716 A * 9/1988 ..... E04G 3/26

OTHER PUBLICATIONS

Screenshot of webpage for Roof Zone Ladder Hook With Wheel, available at https://buymbs.com/p-2618-roof-zone-ladder-hook-with-wheel.aspx, last accessed Aug. 5, 2021, 1 page.
(Continued)

*Primary Examiner* — Colleen M Chavchavadze
(74) *Attorney, Agent, or Firm* — Thedford I. Hitaffer; Hitaffer & Hitaffer, PLLC

(57) ABSTRACT

A roof scaffolding support system comprises two ridge hooks, two cables, and two roof jacks. Each ridge hook comprises a generally J-shaped bar and a cross-bar at a distal end and perpendicular to the J-shaped bar. Each cable comprises a main flexible portion and a plurality of spaced-apart nodules on the main flexible portion that are larger than the main flexible portion. The base of each roof jack defines a slot having an open end for selectively receiving one of the cables to selectively secure the base to its corresponding cable. The slot has a width that is (a) greater than the main flexible portions of the cables and (b) less than the nodules such that the main flexible portion of each cable can pass through the slot of its corresponding base but the nodules of each cable cannot pass through the slot of its corresponding base.

17 Claims, 14 Drawing Sheets

(56) References Cited

U.S. PATENT DOCUMENTS

| | | | | | |
|---|---|---|---|---|---|
| 1,363,864 | A | * | 12/1920 | Grush | E04G 5/041 248/237 |
| 1,580,027 | A | | 4/1926 | Fagg | |
| 1,650,324 | A | * | 11/1927 | Campbell | E04G 3/265 182/147 |
| 1,732,973 | A | | 10/1929 | Krumholz | |
| 2,448,746 | A | | 3/1946 | Sundeen | |
| 3,526,296 | A | * | 9/1970 | Stevens | E04G 3/265 182/45 |
| 3,842,934 | A | | 10/1974 | Bartlett | |
| 4,398,620 | A | * | 8/1983 | Townsend | E04G 3/265 182/17 |
| 5,249,397 | A | | 10/1993 | Monaco | |
| 5,320,194 | A | * | 6/1994 | Bredijk | E04G 3/26 248/237 |
| 5,397,090 | A | * | 3/1995 | Carson | E04B 9/20 52/506.07 |
| 5,845,740 | A | | 12/1998 | Bouwkamp | |
| 6,299,118 | B1 | * | 10/2001 | Farrell | A01G 9/024 248/323 |
| 7,073,761 | B2 | * | 7/2006 | Diggle | H02G 3/30 248/58 |
| 8,177,027 | B2 | | 5/2012 | Borra | |
| 8,714,305 | B2 | | 5/2014 | Fontaine | |
| 9,273,515 | B2 | * | 3/2016 | O'Grady, Sr. | E06C 1/345 |
| 9,308,403 | B2 | * | 4/2016 | Strawder | E04D 13/00 |
| 9,551,184 | B2 | * | 1/2017 | Webster | E06C 1/381 |
| 12,044,021 | B2 | * | 7/2024 | Schwartz | E04G 3/34 |
| 2007/0034449 | A1 | | 2/2007 | Leendertse | |
| 2008/0020909 | A1 | | 1/2008 | Blair | |
| 2012/0061178 | A1 | * | 3/2012 | Mathieson | E04G 3/26 182/45 |

OTHER PUBLICATIONS

Screenshot of webpage for The Ridgepro Plus, available at https://www.theridgepro.com/products/the-ridgepro-plus, last accessed Aug. 5, 2021, 1 page.

* cited by examiner

SYSTEM AND METHOD FOR SUPPORTING WORKERS AND MATERIAL ON A SLOPED ROOF

CROSS-REFERENCE TO RELATED APPLICATIONS

This application claims priority to pending U.S. Provisional Application Ser. No. 63/067,827, filed Aug. 19, 2020, and U.S. Provisional Application Ser. No. 63/159,639, filed Mar. 11, 2021, the contents of which are incorporated herein by reference in their entirety.

FIELD OF THE INVENTION

The present technology relates generally to scaffolding and safety systems for roofing.

BACKGROUND OF THE DISCLOSURE

When working on a sloped roof of a building, it is helpful and increases safety to install a temporary work platform of some sort on the roof. One conventional way to install such a work platform is to temporarily affix two or more conventional roof jacks to the roof and place a long support board (e.g., a 2x10 wooden plank) (often termed a "walk board" or a "scaffolding board") across the roof jacks. Materials (e.g., bundles of shingles) may be set on the board, and workers may stand on the board when the roof jacks and walk board are installed.

To install a conventional roof jack, a portion of roof shingle is lifted up, the top end of the roof jack is placed under the lifted shingle portion, and one or more nails are driven into one or more angled slots. When it is time to move the roof jacks and walk board further up the roof, the roof jacks are slid off the nails, the nails are removed, the nail holes are sealed, the lifted shingle portion is adhered back in place, and the process is repeated at a different location on the roof. Slate, tile, and cedar shingles must first be removed prior to installing roof brackets, thus risking breaking the shingles during the tedious removal process. Conventional roof jacks cannot be installed on standing seam metal roofs because penetrations would have to be made in the metal panels, however some conventional roof jacks can be used on metal roofs by attaching anchoring points to the vertical portion of the standing seam.

Conventional installation of conventional roof jacks risks damaging the roof in that the nail holes may not be properly sealed and the lifted portion of the shingle may break. What is needed is a system for supporting workers and material on a sloped roof that is easily installed, moved, and removed without causing damage to the roof.

BRIEF SUMMARY OF THE DISCLOSURE

In one embodiment of the invention, a roof scaffolding support system comprises two ridge hooks, two cables, and two roof jacks. Each ridge hook comprises (a) a generally J-shaped bar having a proximal end, a straight portion, a curved portion, and a distal end and (b) a cross-bar affixed to or integral with the distal end and perpendicular to the J-shaped bar. Each ridge hook is adapted to be positioned across a ridge of a roof such that the proximal end is on a first sloped side of the ridge and the distal end is on a second sloped side of the ridge. Each cable is selectively attachable to a corresponding one of the ridge hooks. Each cable comprises (a) a main flexible portion having a proximal end and a distal end and (b) a plurality of spaced-apart nodules affixed to or integral with the main flexible portion. Each nodule has a dimension perpendicular to a longitudinal axis of the main flexible portion that is larger than a diameter of the main flexible portion. Each roof jack comprises a base adapted to sit on the first sloped side of the roof and an angled support portion affixed to or integral with the base and adapted to support at least a portion of a scaffolding board. The base of each roof jack defines a slot having an open end for selectively receiving the main flexible portion of a corresponding one of the cables to selectively secure the base to its corresponding one of the cables. The slot defined in the base of each roof jack has a width that is (a) greater than the diameter of the main flexible portions of the cables and (b) less than the dimension of the nodules of the cables such that the main flexible portion of each cable can pass through the slot of its corresponding base but the nodules of each cable cannot pass through the slot of its corresponding base.

Each ridge hook may comprise an attachment mechanism to for selectively attaching one of the cables to the proximal end of the corresponding ridge hook.

The base of each roof jack may further comprise a gate for selectively blocking the open end of the slot to secure the main flexible portion of the corresponding cable in the slot.

Each roof jack may further comprise two or more feet projecting from an underside of the base such that each base is adapted to sit on the first sloped side of the roof with the underside of the base spaced apart from the first sloped side of the roof at a distance corresponding to a height of the feet. The two or more feet of each roof jack may comprise two elongated, parallel feet which are adapted to be positioned perpendicular to the roof ridge when the base of each roof jack sits on the first sloped side of the roof.

Each ridge hook may comprise one or more wheels affixed to the curved portion of each ridge hook. The one or more wheels of each ridge hook may be attached to the curved portion of each corresponding ridge hook at a position that is closer to the distal end than to the straight portion of the corresponding ridge hook. The one or more wheels of each ridge hook may be attached to the curved portion of each corresponding ridge hook at a position such that (a) in a direction perpendicular to the straight portion, the wheels extend further away from the straight portion than does the cross-bar and (b) in a direction parallel to the straight portion, the wheels are further away from the proximal end than is the cross-bar. The one or more wheels of each ridge hook may be attached to the curved portion of each corresponding ridge hook at a position such that (a) in a direction perpendicular to the straight portion, a portion of the wheels that is furthest away from the straight portion is further away from the straight portion than is a portion of the cross-bar that is furthest away from the straight portion and (b) in a direction parallel to the straight portion, a portion of the wheels that is closest to the proximal end is further away from the proximal end than is a portion of the cross-bar that is closest to the proximal end.

The system may further comprise two or more elongated poles, each elongated pole selectively attachable to the proximal end of a corresponding ridge hook. Each elongated pole may comprise a handle affixed to or integral with a proximal end of the elongated pole. Each handle may comprise a first handle portion extending perpendicular to the elongated pole and a second handle portion extending perpendicular to the elongated pole in a direction opposite the first handle portion.

In addition to the roof scaffolding support system described herein, alternative embodiments of the invention may comprise methods of supporting a scaffolding board on a roof In alternative embodiments of the invention, a roof ridge hook comprises a generally J-shaped bar having a proximal end, a straight portion, a curved portion, and a distal end, a cross-bar affixed to or integral with the distal end of the J-shaped bar and perpendicular to the J-shaped bar, and one or more wheels affixed to the curved portion of the J-shaped bar. The ridge hook is adapted to be positioned across a ridge of a roof such that the proximal end is on a first sloped side of the ridge and the distal end is on a second sloped side of the ridge.

The one or more wheels may be attached to the curved portion of the J-shaped bar at a position that is closer to the distal end than to the straight portion of the J-shaped bar.

The one or more wheels may be attached to the curved portion of the J-shaped bar at a position such that (a) in a direction perpendicular to the straight portion, the wheels extend further away from the straight portion than does the cross-bar and (b) in a direction parallel to the straight portion, the wheels are further away from the proximal end than is the cross-bar.

The one or more wheels may be attached to the curved portion of the J-shaped bar at a position such that (a) in a direction perpendicular to the straight portion, a portion of the wheels that is furthest away from the straight portion is further away from the straight portion than is a portion of the cross-bar that is furthest away from the straight portion and (b) in a direction parallel to the straight portion, a portion of the wheels that is closest to the proximal end is further away from the proximal end than is a portion of the cross-bar that is closest to the proximal end.

The roof ridge hook may further comprise an elongated pole selectively attachable to the proximal end of the J-shaped bar. The elongated pole may comprise a handle affixed to or integral with a proximal end of the elongated pole. Each handle may comprise a first handle portion extending perpendicular to the elongated pole and a second handle portion extending perpendicular to the elongated pole in a direction opposite the first handle portion.

The roof ridge hook may further comprise one or more anchoring plates. Each anchoring plate comprises a planar tab having a plurality of holes defined therein and a sleeve for selectively receiving at least a portion of the cross-bar. The planar tab is adapted to be secured to the roof via insertion of each of a plurality of nails, screws, or bolts through a corresponding one of the plurality of holes and into the roof.

The cross-bar may comprise two cylinders protruding perpendicularly from the J-shaped bar in opposite directions. The one or more anchoring plates may comprise two anchoring plates. The sleeve of each anchoring plate may comprise a cylindrical sleeve. The cylindrical sleeve of each anchoring plate may selectively receive a corresponding one of the two cylinders of the cross-bar.

BRIEF DESCRIPTION OF THE SEVERAL VIEWS OF THE DRAWINGS

The foregoing summary, as well as the following detailed description of the disclosure, will be better understood when read in conjunction with the appended drawings. For the purpose of illustrating the disclosure, there are shown in the drawings embodiments which are presently preferred. It should be understood, however, that the disclosure is not limited to the precise arrangements and instrumentalities shown. In the drawings.

DETAILED DESCRIPTION OF THE DISCLOSURE

Figure 1:
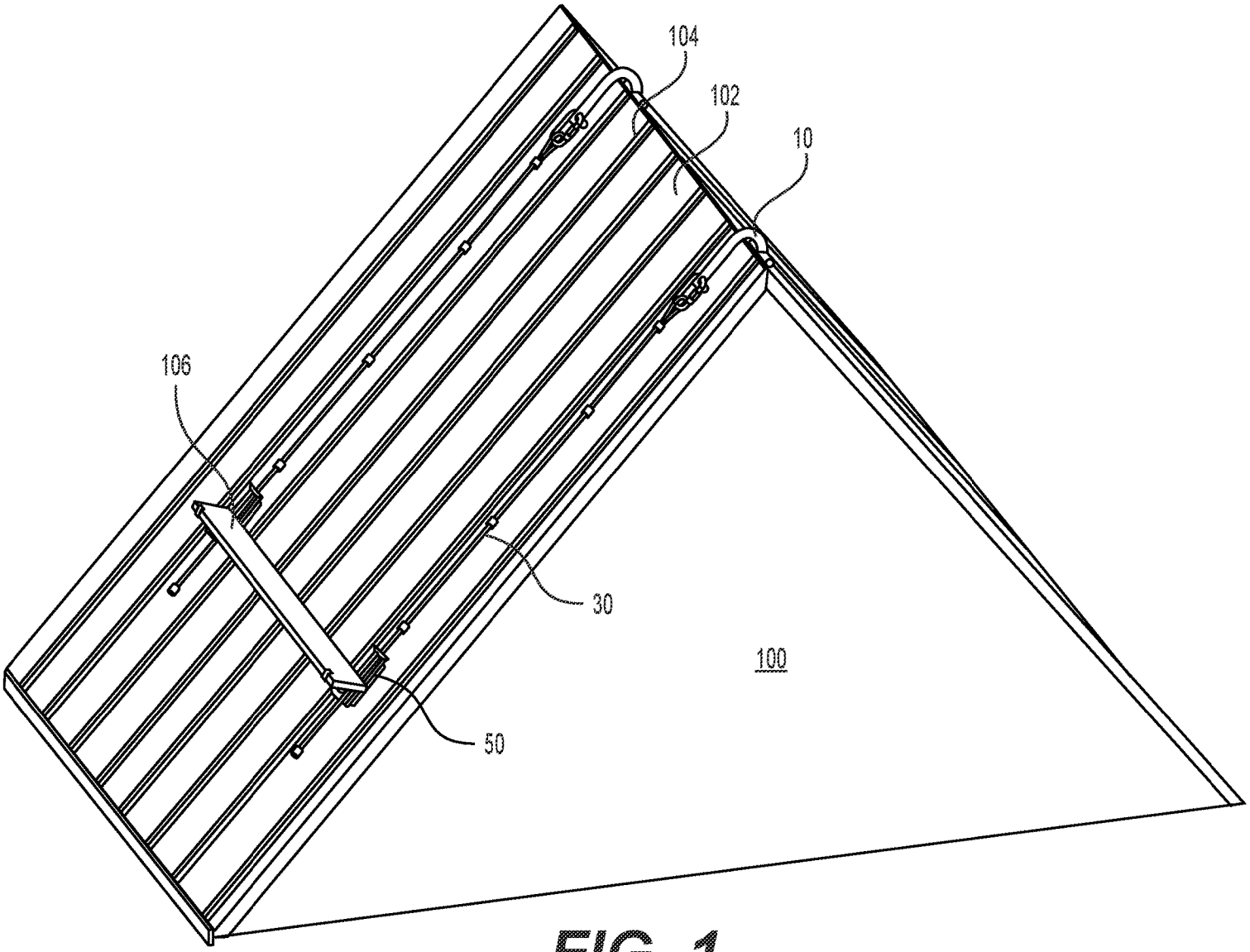
FIG. 1 is a perspective view of a system for supporting workers and material on a sloped roof, in use on a roof, in accordance with embodiments of the present invention.
Figure 2:
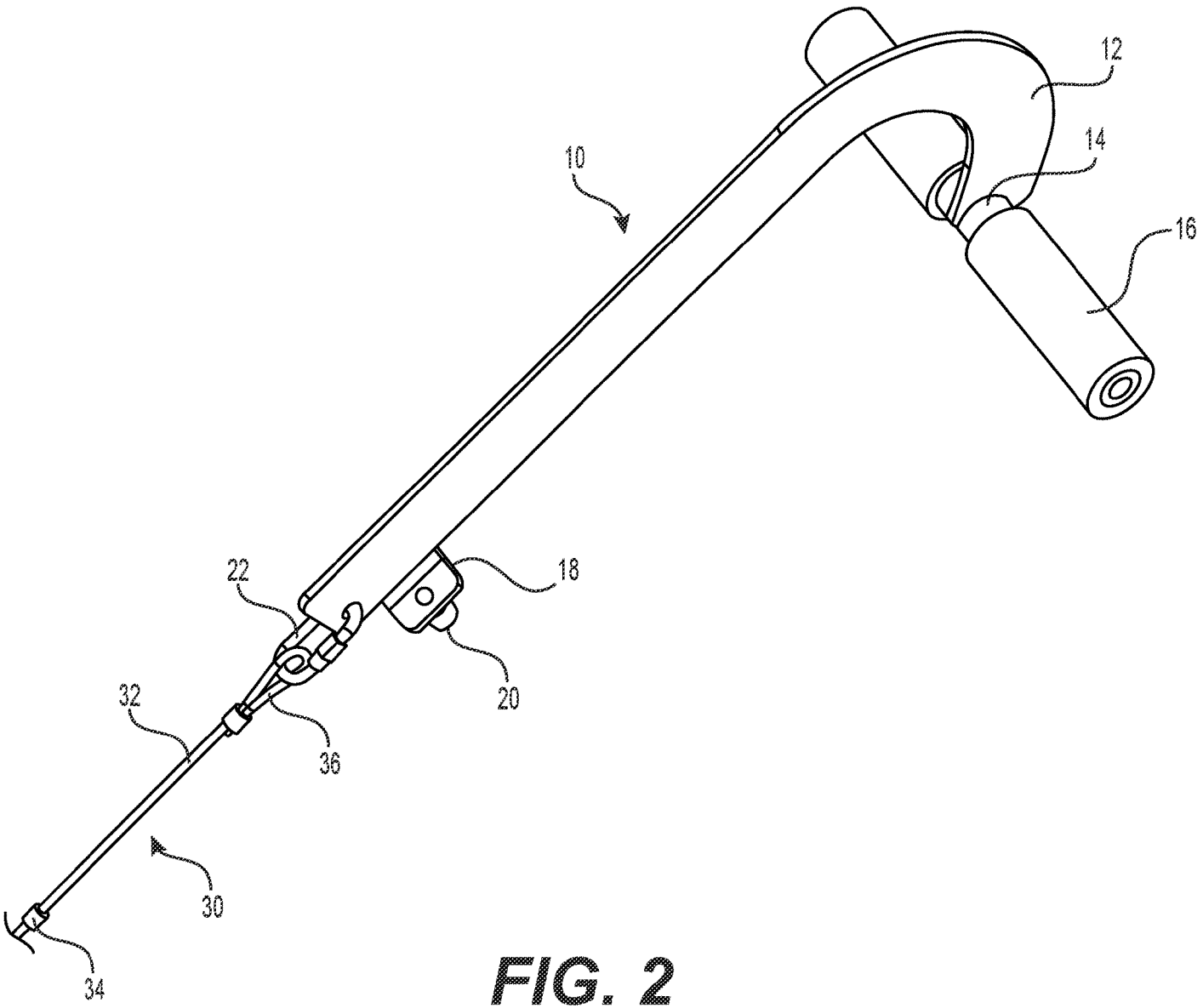
FIG. 2 is a perspective view of a ridge hook portion of the system of FIG. 1.

Certain terminology is used in the following description for convenience only and is not limiting. The words "lower," "bottom," "upper," "top," and the like designate directions in the drawings to which reference is made. The words "inwardly," "outwardly," "upwardly," "downwardly," and the like refer to directions toward and away from, respectively, the geometric center of the device, and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import.

Embodiments of the invention comprise a system and method for supporting workers and material on a sloped roof. The system of embodiments of the invention provides a novel way of supporting a long support board (e.g., a 2×10 wooden plank, which may be termed a "scaffolding board" or a "walk board") on a sloped roof in a manner that is safe, secure, easy to set up and move, and eliminates the need for conventional roof jacks which require a user to bend shingles and drive nails into the roof deck. The system comprises a device that non-invasively sits on and spans a roof ridge, a device that non-invasively sits on a sloped roof, and a flexible cable, rope, or the like (collectively referred to herein as a "cable") that spans between the two devices. The cable has a plurality of attachment points, such that the device that sits on the sloped roof and supports the walk board can be attached to any one of the attachment points to position the walk board at a plurality of different positions along the slope of the roof.

Referring now to the figures, a system for supporting workers and material on a sloped roof of embodiments of the invention comprises a ridge hook portion 10, a roof jack portion 50 that sits on the sloped roof, and an elongated flexible cable 30 that spans between ridge hook portion 10 and the roof jack portion 50 and supports the roof jack portion 50 at a variety of different distances from the ridge hook portion 10. The system typically comprises at least two of each of these three components in order to provide at least two points of support for a scaffolding board. FIG. 1 illustrates two of each of these three components positioned on a roof 102 of a house 100. Each of the two ridge hook portions 10 is positioned across the ridge of the roof 102. Each of the two cables 30 are attached at the upper or distal end to a corresponding one of the ridge hook portions 10. Each of the roof jack portions 50 are attached to a corresponding one of the cables 30, each at the same distance from its corresponding ridge hook portion 10. A scaffolding board 106 spans between the two roof jack portions 50 to provide a secure platform for supporting materials and workers during work (installation, repairs, etc.) on the roof 102.

The ridge hook portion 10 comprises a J-shaped main body 12 with a crossbar 14 extending perpendicularly from the curved end of the main body 12. The main body 12 is vertical when in use and is planar. The crossbar 14 comprises two generally cylindrical portions projecting outward on opposing sides of the main body 12. The J-shaped main body 12 and the cross-bar 14 will likely be constructed of aluminum or any other suitable metal. The cylindrical portions of the crossbar 14 may have protective covers 16 to help prevent damage to the roof surface, especially by protecting the factory painted finish on metal roof panels. The protective covers 16 may be constructed of rubber, silicone, or any other suitable material. The protective covers 16 may be removably or non-removably attached to the crossbar 14. As described further below, the crossbar 14 may interface with an anchoring mechanism for securely affixing the ridge hook portion 10 to a roof such that the ridge hook portion 10 may function as an anchoring point for workers on the roof. Such an anchoring mechanism may be removably or non-removably affixed to the crossbar 14. Such an anchoring mechanism would typically enable the ridge hook portion 10 to be (indirectly) nailed or screwed to the roof surface.

At or near the lower end of the ridge hook portion 10 there may be a foot 20 (shown attached to a lateral bracket 18) to elevate the lower end of the ridge hook portion 10 above the roof surface when the ridge hook portion 12 sits on the roof to help protect the roof surface from damage. The foot 20 may be constructed of rubber, silicone, or any other suitable material. At or near the lower end of the ridge hook portion 10 a carabiner 22 (or any other suitable attachment mechanism) may be used to selectively attach the cable 30 to the ridge hook portion 10.

Figure 3:
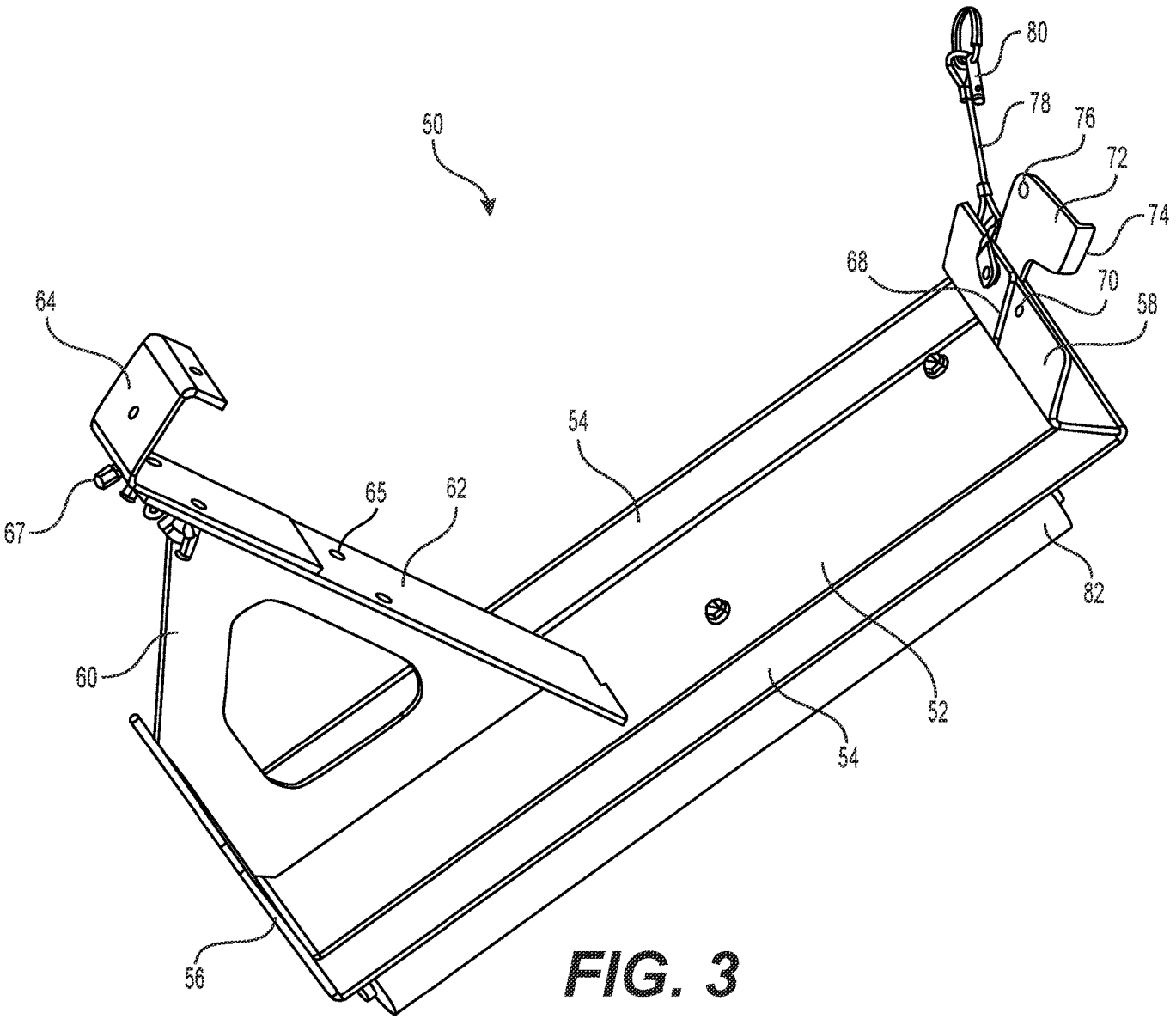
FIG. 3 is a top perspective view of a roof jack portion of the system of FIG. 1.
Figure 4:
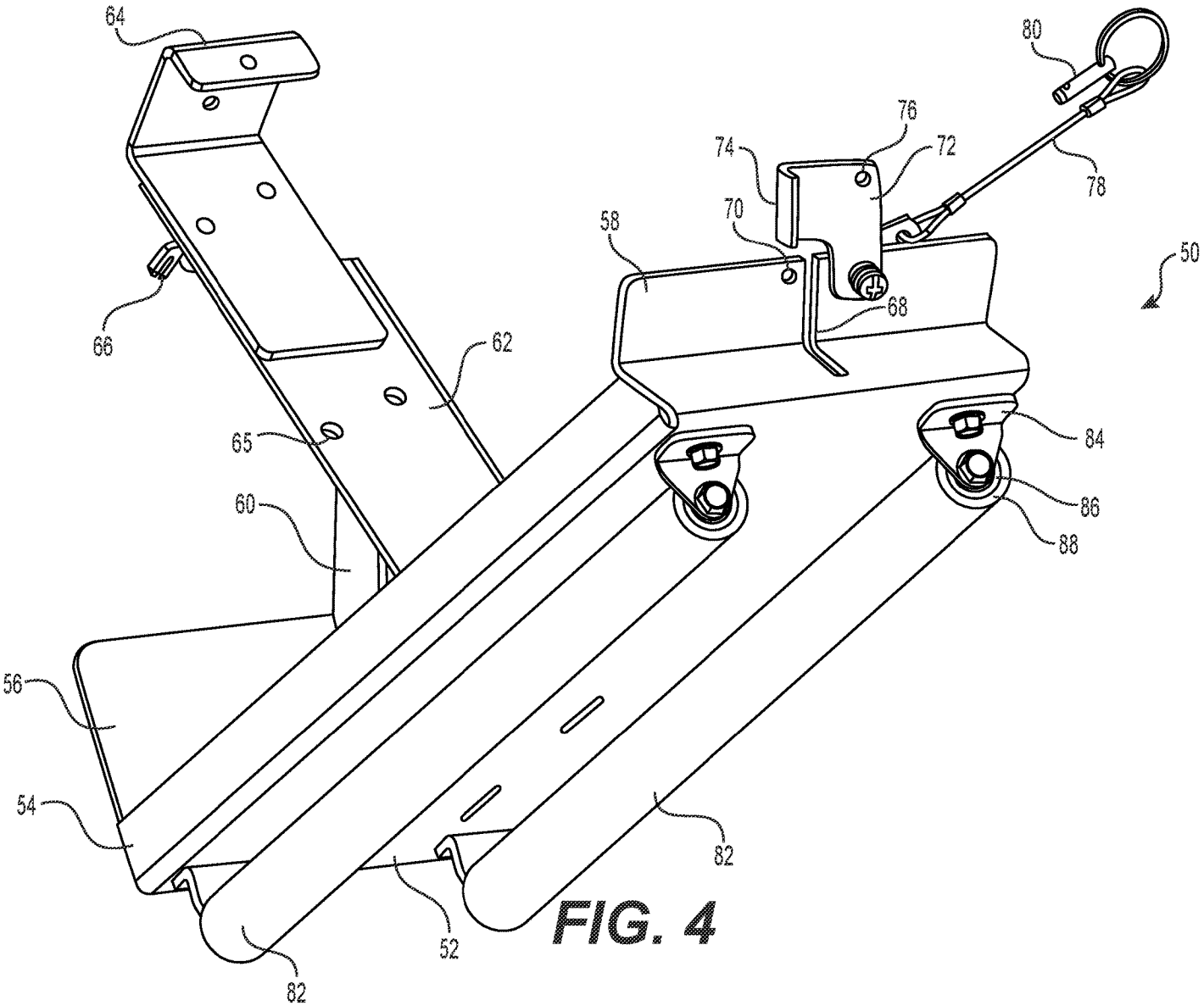
FIG. 4 is a bottom perspective view of the roof jack portion of the system of FIG. 1.
Figure 5:
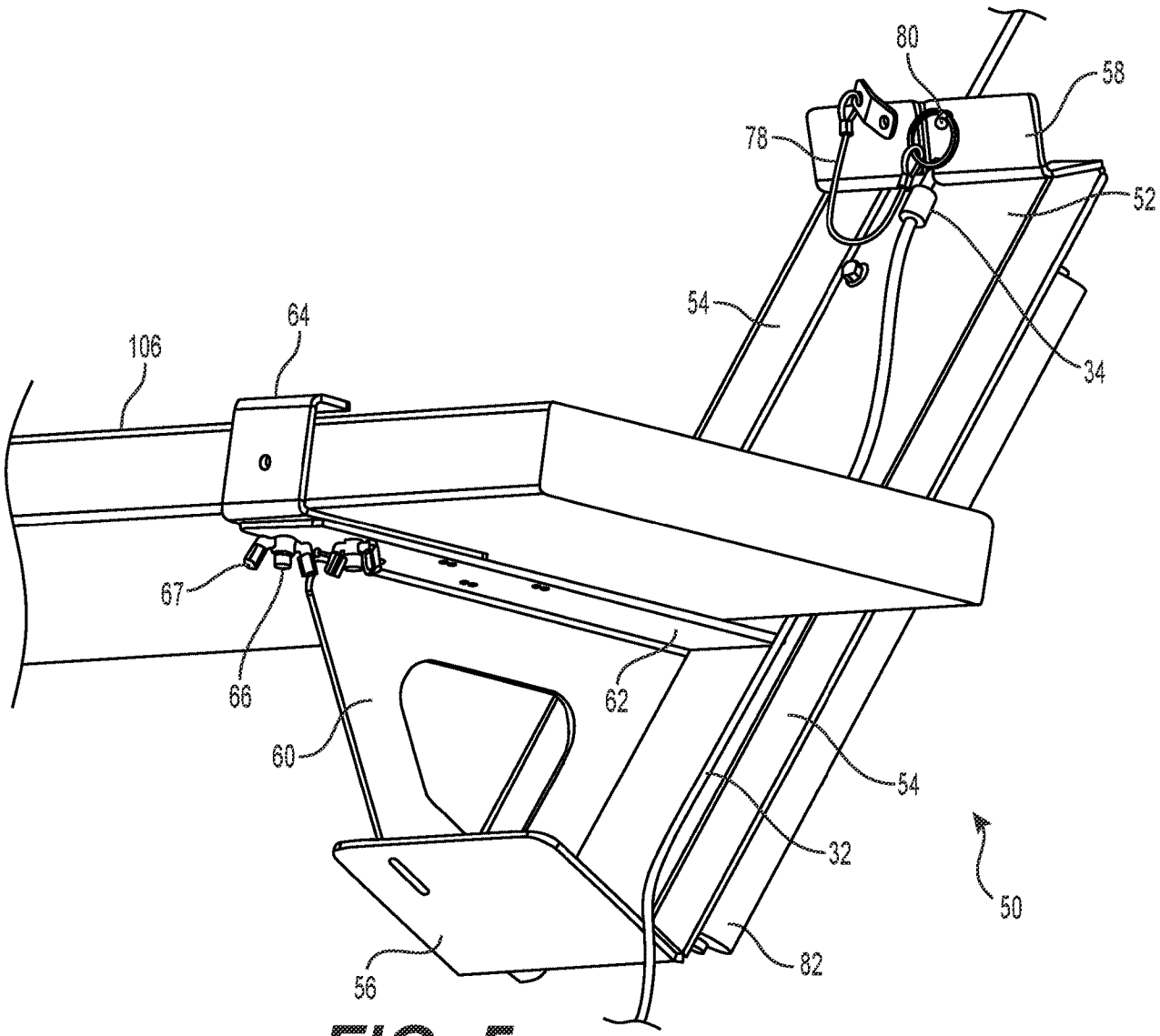
FIG. 5 is a top perspective of the roof jack portion of the system of FIG. 1, in use supporting a scaffolding board.
Figure 6:
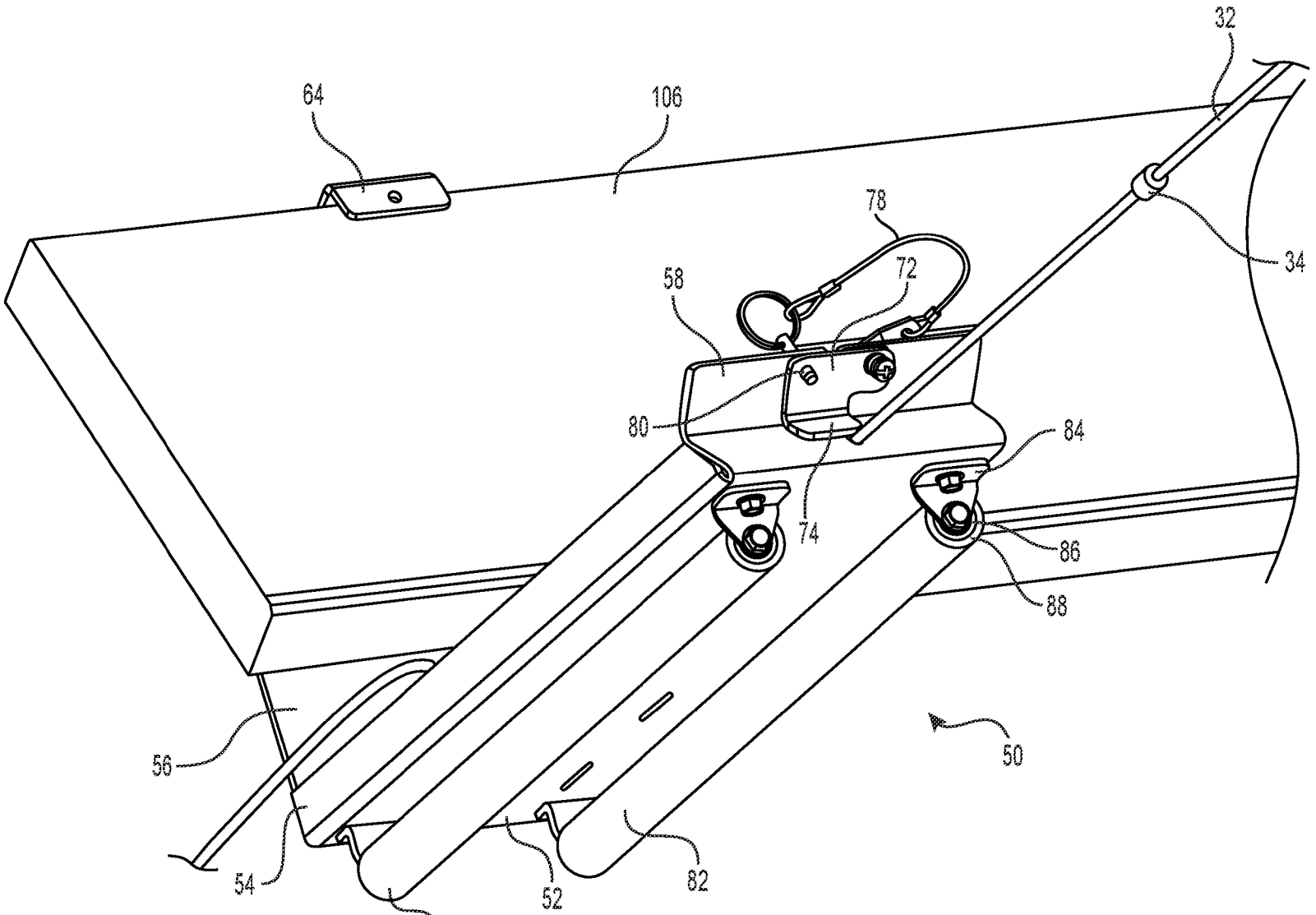
FIG. 6 is a bottom perspective of the roof jack portion of the system of FIG. 1, in use supporting a scaffolding board.

The roof jack portion 50 comprises a base 52 having an elongated flat portion that sits parallel to the roof surface when installed. The roof jack portion 50 comprises a front wall 58 that projects upward from the top end of the elongated flat portion and a rear wall 56 that projects upward from the bottom end of the elongated flat portion. In the illustrated embodiment, the front wall 58 has a bent arrangement which provides additional rigidity. An attachment slot 68 is defined in the front wall 58 to receive the cable 30. A locking gate 72 swings between an open position (shown in FIGS. 3 and 4) which allows the cable 30 to be inserted into the attachment slot 68 and a closed position (shown in FIGS. 5 and 6) which securely retains the cable 30 in the attachment slot 68. FIGS. 5 and 6 shows the cable 30 retained in the attachment slot 68. The locking gate 72 has a bent portion 74 that corresponds to the bent arrangement of the front wall 58. When the locking gate 72 is closed, a hole 76 in the locking gate 72 aligns with a hole 70 in the front wall 58. A locking pin 80 is selectively insertable into the aligned holes to securely retain the locking gate 72 in the closed position. A short cable 78 retains the locking pin 80 when the locking pin 80 is not in use to prevent loss.

The roof jack portion 50 further comprises support panels 54 that are contiguous with or affixed to (such as by welding) the opposing side edges of the flat portion and are also affixed to (such as by welding) the front wall 58 and the rear wall 56 to provide additional strength and rigidity to the roof jack portion.

The roof jack portion 50 comprises an angled board-support portion 62 upon which the walk board sits. The angled board-support portion 62 is supported by a support bracket 60 that is affixed to the flat portion 52 and the rear wall 56. The angle of the angled board-support portion 62 to the flat portion 52 is selected such that the walk board is supported in a horizontal or near-horizontal orientation when the angled board-support portion 62 is in place on a sloped roof, such that workers may safely stand and material may be safely supported on the walk board. In the illustrated embodiments, the angle of the angled board-support portion 62 to the flat portion 52 is 115 degrees, which is intended to be used on roofs with a pitch of 8/12 to 14/12 (approximately 35-49 degrees). The angled board-support portion 62 has an adjustable distal end 64 to accommodate walk boards of different widths (typically 6, 8, and 10 inch nominal widths). The distal end 64 is sized to receive a walk board with a nominal thickness of two inches. One or more holes are defined in the distal end 64 to enable insertion of a screw through the hole and into the walk board to secure the walk board to the roof jack portion 50. As best seen in FIG. 5, the distal end 64 is adjustable by inserting the threaded pins 66 projecting from the underside of the distal end 64 into any one of several pairs of corresponding holes 65 spaced along the board-support portion 62 (or any other suitable mechanism or method). The adjustable distal end 64 may be secured in the selected position using, for example, wing nuts 67 secured to the threaded pins 66 (or any other suitable mechanism or method). The base portion 52 and the angled board-support portion 62 will likely be constructed of aluminum or any other suitable metal.

A plurality of feet 82 are attached to the underside of the flat portion 52. When in use, the feet 82 hold the flat portion 52 away from the roof surface a distance that corresponds to the height of the feet 82 (including the height of any structure attaching the feet to the flat portion). This, in turn, holds the scaffolding board 106 a similar distance away from the roof surface (plus some additional spacing caused by the structure of the roof jack portion, such as the support panels 54). This gap between the scaffolding board 106 and the roof surface is particularly advantageous when installing standing seam roofing, as the roof panels may be slid under the scaffolding board 106 during installation without moving or removing the walk board 106. In one embodiment of the invention, the feet may be about 1.5-2.0 inches tall, which would be tall enough to position the scaffolding board above the standing seams 104 of a typical metal roof. In the illustrated embodiment, the feet 82 are elongated, which helps distribute the weight and reduce the likelihood of damaging the roof, and cylindrical. The feet 82 comprise an elongated cylindrical internal tube 86 affixed to the underside of the flat portion 52 via mounting brackets 84. The tubes 86 are surrounded by a cushioning tube 88, which may be constructed of rubber, silicone, or any other suitable material. The cushioning tube 88 helps prevent damage to the roof surface, especially by protecting the factory painted finish on metal roof panels.

Figure 7:
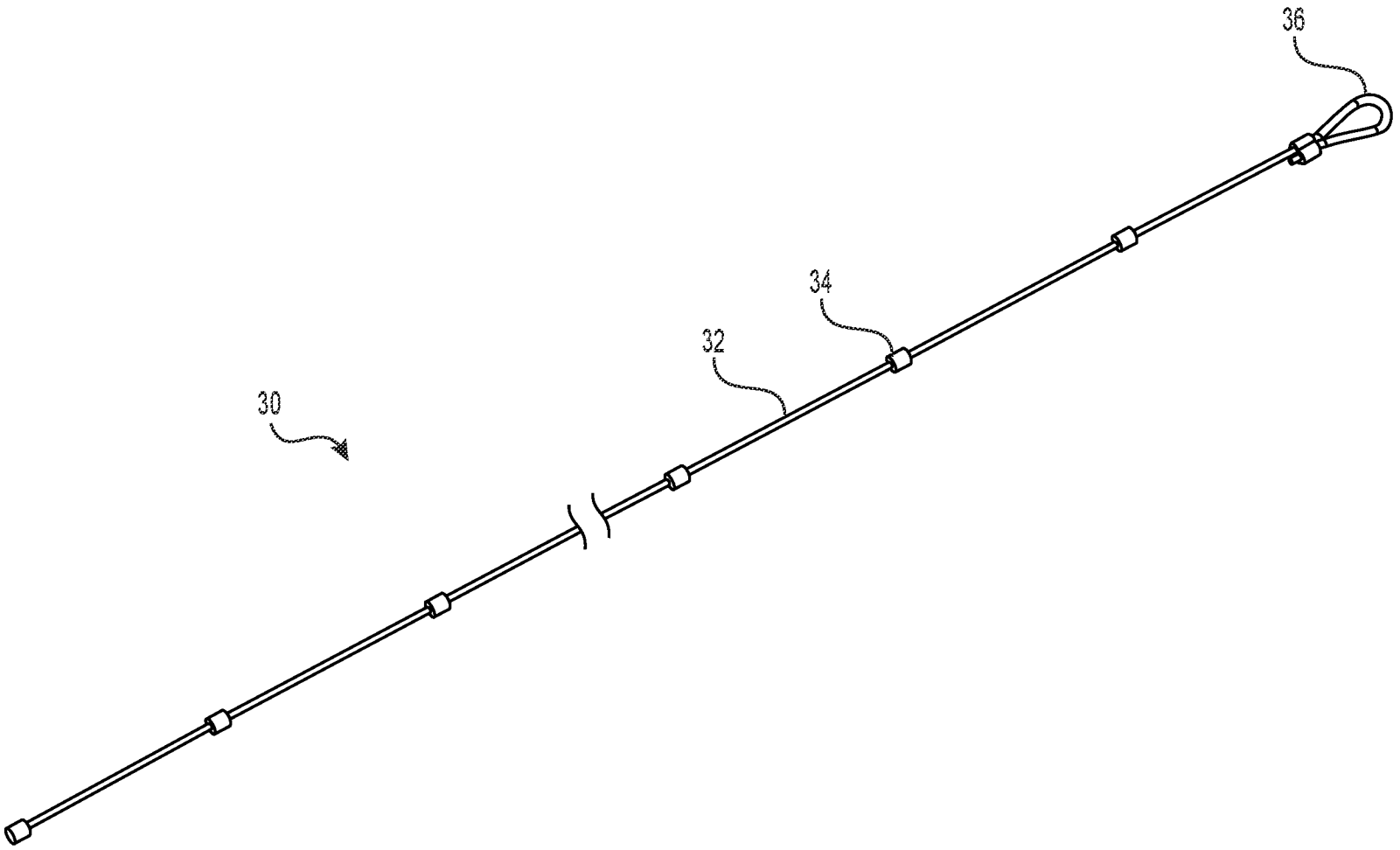
FIG. 7 is a perspective view of a cable of the system of FIG. 1.
Figure 8:
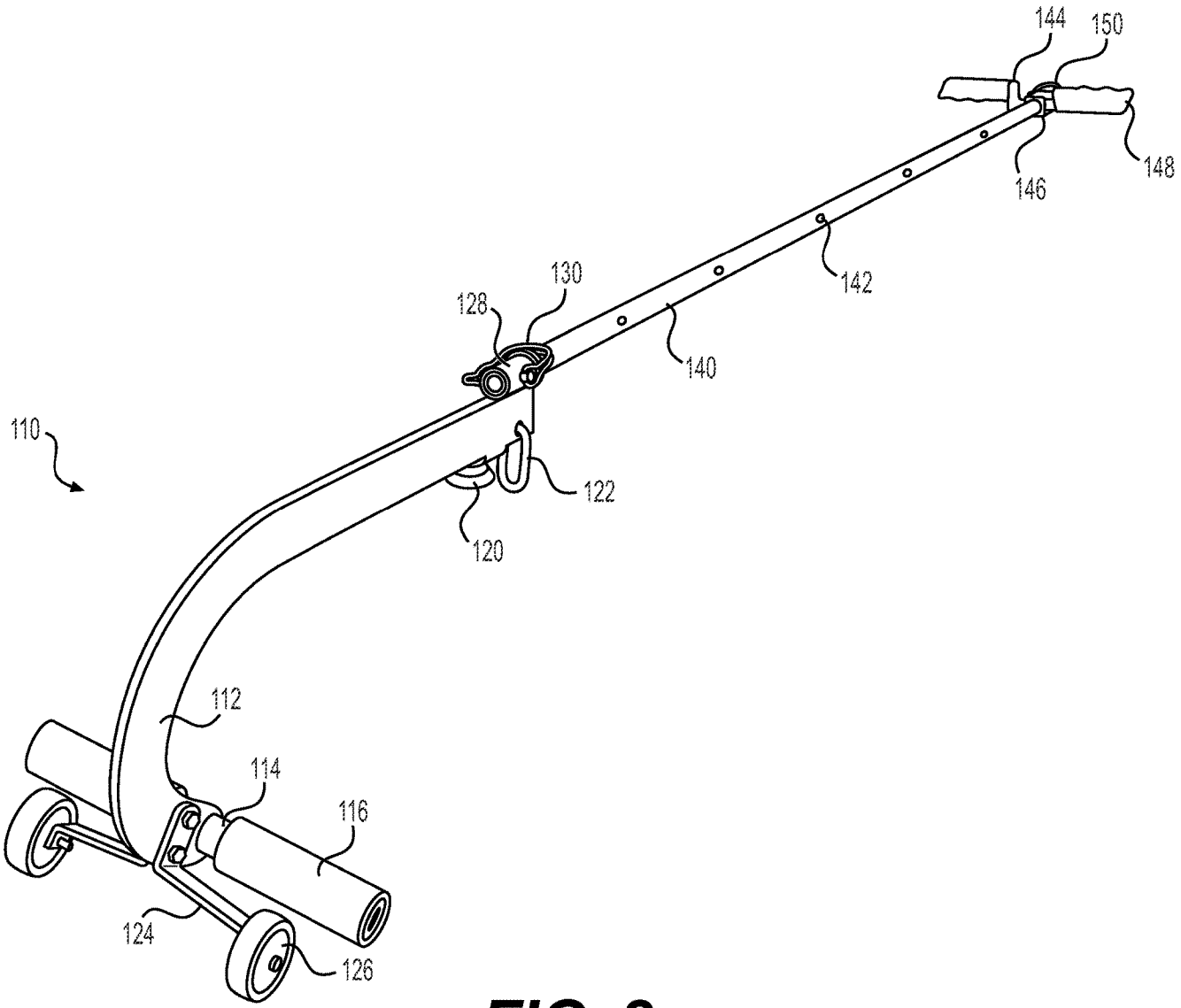
FIG. 8 is perspective view of a ridge hook system, in accordance with alternative embodiments of the present invention.
Figure 9:
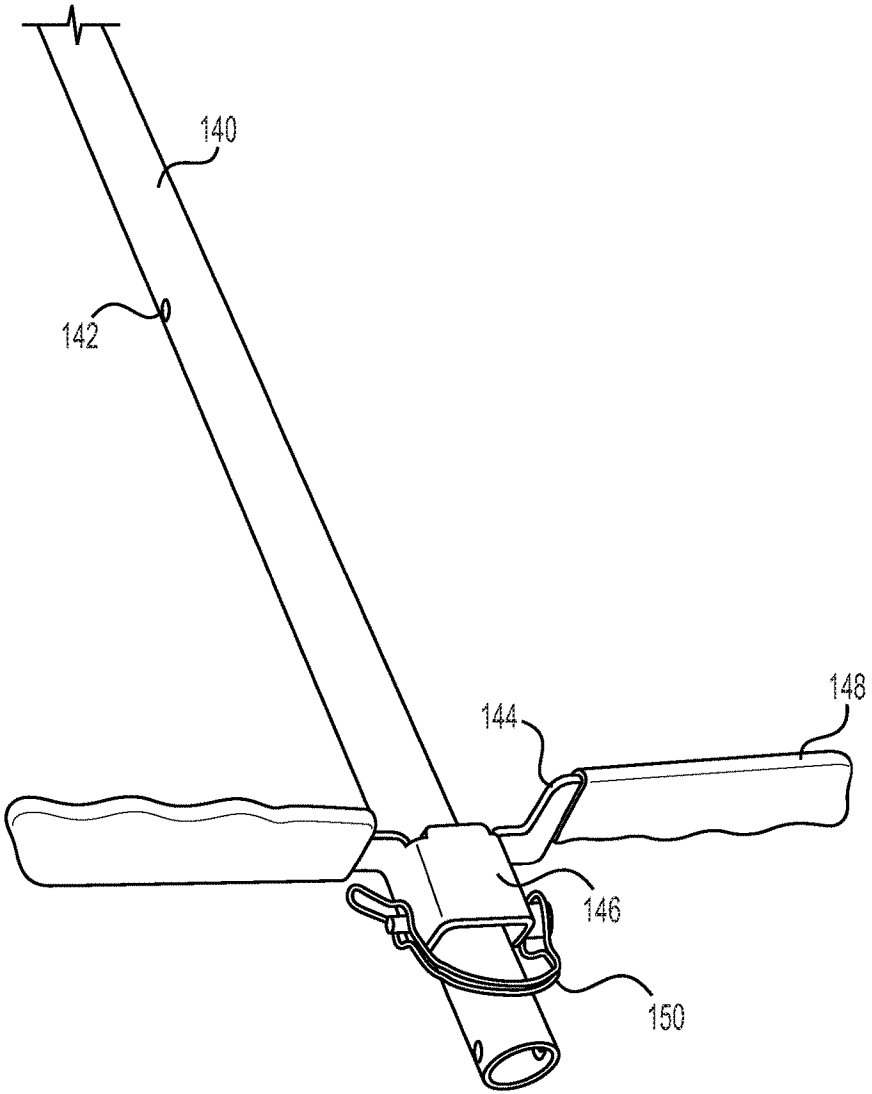
FIG. 9 is a perspective view of a handle of the system of FIG. 8.
Figure 10:
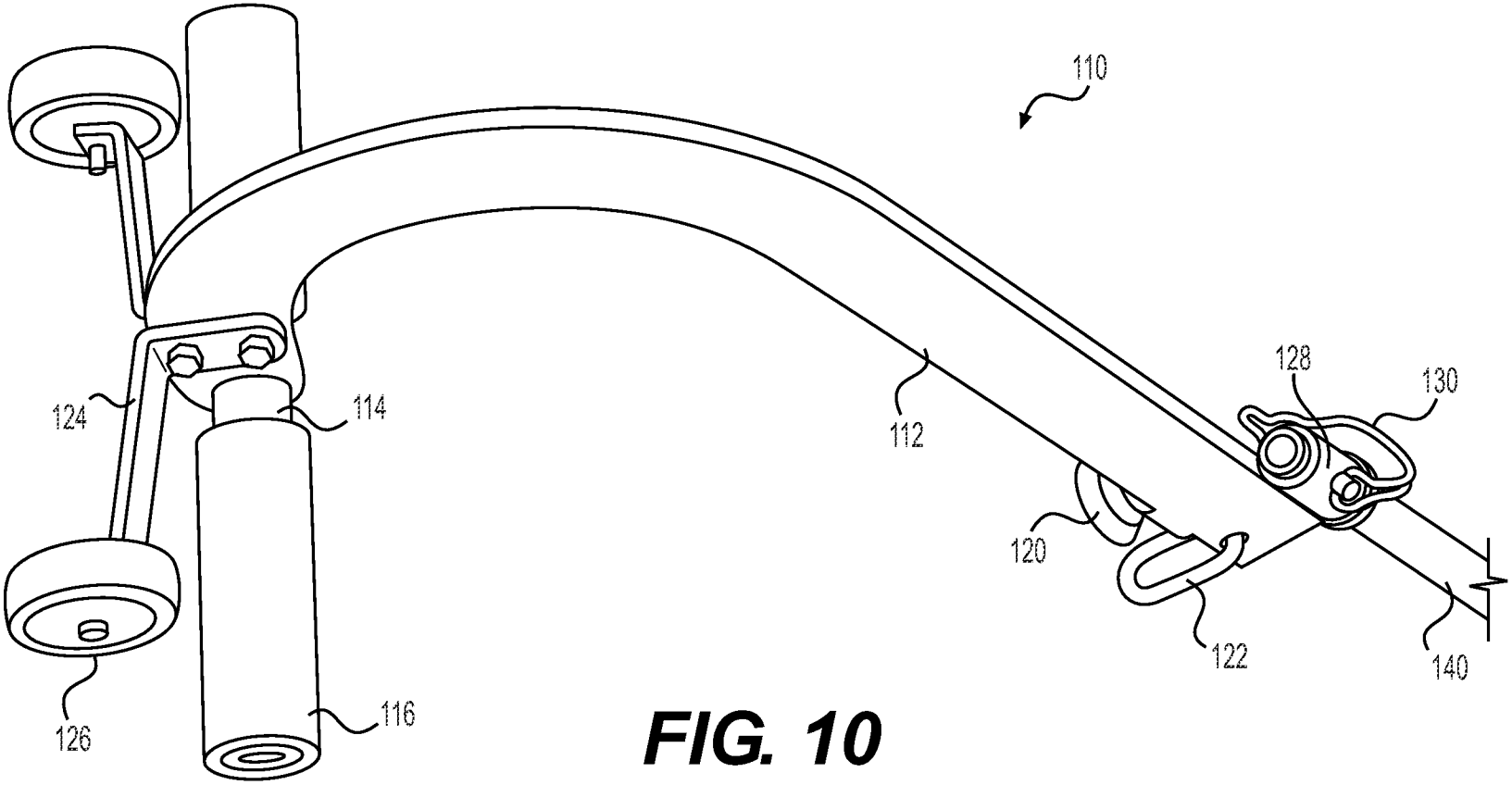
FIG. 10 is a perspective view of the ridge hook portion of the system of FIG. 9.
Figure 11:
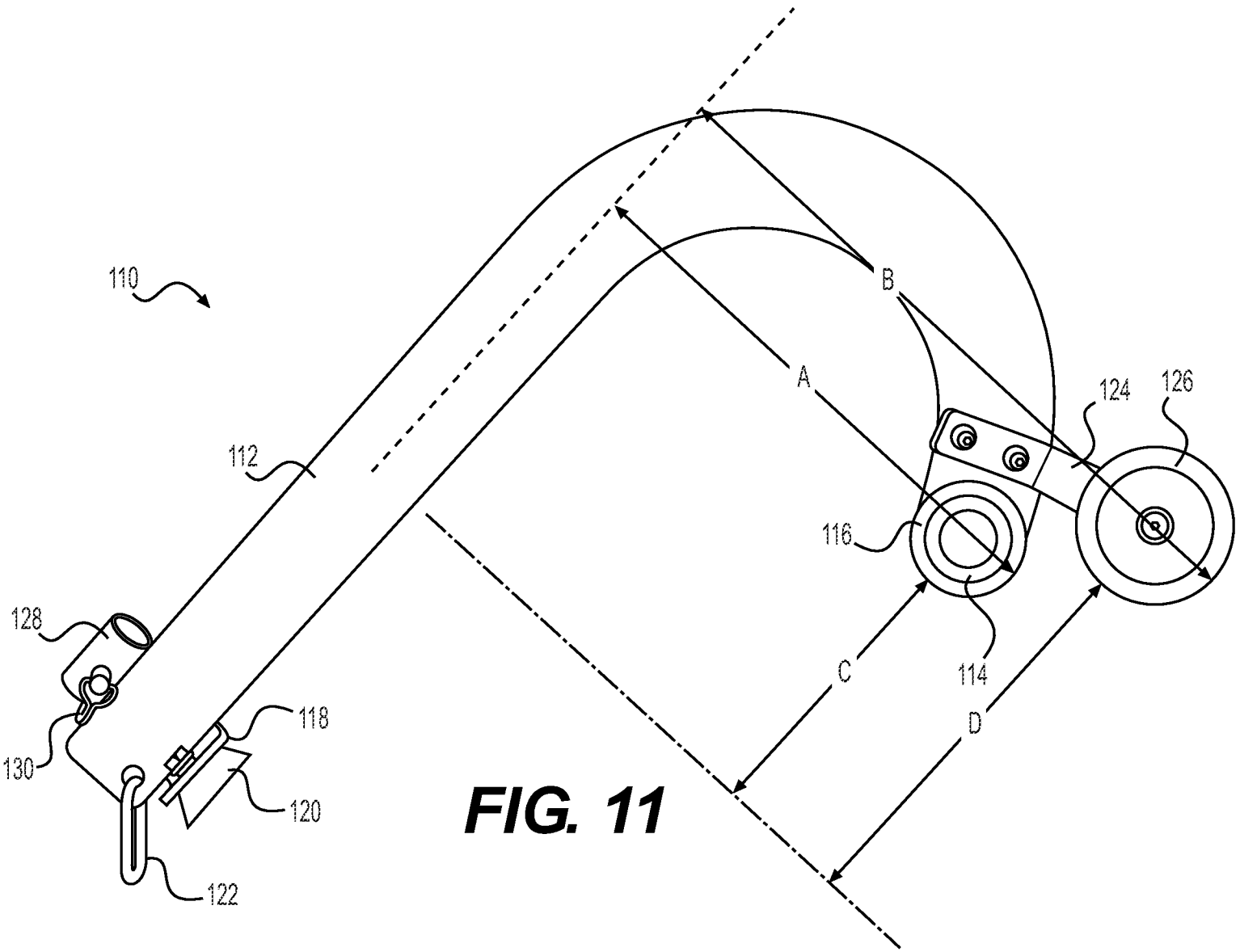
FIG. 11 is a side view the ridge hook portion of the system of FIG. 9.

As best seen in FIG.7, the cable 30 comprises a main flexible portion 32 and a plurality of attachment points or nodules 34 attached to or integral with the main flexible portion 32. In the illustrated embodiment, the attachment points 34 are cylinders that are affixed to the cable at intervals (typically at regular intervals, such as every 12, 18, or 24 inches). (The attachment points may have any other suitable shape, such as spherical.) The attachment point cylinders 34 have a diameter (i.e., the dimension that is perpendicular to the longitudinal axis of the main flexible portion 32) that is larger than the diameter of the main flexible portion 32. The diameter of the main flexible portion 32 is selected such that the cable can fit into the attachment slot 68 of the roof jack portion 50. The diameter of the cable attachment points 34 is selected such that the cable attachment points 34 cannot pass through the attachment slot 68 of the roof jack portion 50. In one exemplary embodiment, the attachment slot 68 is 0.213 inch wide, the main flexible portion 32 comprises a 0.125 inch diameter steel wire, and the cable attachment points 34 comprise steel cylinders with a 0.375 inch diameter and a length of 0.500 inches. The cable 30 may be any suitable length to span a variety of different roofs from the ridge to the eaves. In one exemplary embodiment, the cable is about twenty feet long. At a distal or upper end of the cable 30, an attachment loop 36 is formed in the cable to enable attachment of the cable 30 to the carabiner 22 of the ridge hook portion 10. In a simple embodiment, the cable could be a rope and the attachment points could be knots tied in the rope at regular intervals. The number and spacing of the cable attachment points 34 determines possible positions of the roof jack portion.

Because there is a plurality of spaced-apart attachment points 34, more than one roof jack portion 50 may be attached to and supported by a single cable 30. Although not illustrated, the embodiment of the invention illustrated in FIGS.1-7 is designed to enable each cable 30 to support three roof jack portions 50. In this regard, using two ridge hooks 10, two cables 30 and six roof jack portions 50 enable three walk boards 106 to be supported at three different positions along the slope of the roof. The ability to support multiple walk boards along with the spacing between the walk boards and the roof that is provided by the feet 82 on the roof jack portions 50 is particularly helpful when installing standing seam metal roofing panels.

Alternative embodiments of the invention may comprise methods of installing a system for supporting workers and material on a sloped roof as described herein, and methods of supporting material and/or workers on a slope roof using a system for supporting workers and material on a sloped roof as described herein. One such method comprises positioning two or more ridge hook portions, cables, and roof jack portions of embodiments of the invention on a roof, as described herein.

The current invention provides significant advantages over the conventional use of roof jacks, especially for metal, tile, slate, and cedar roofs (often termed "hardscape roofs"). When used with shingle roofs, there is no need to lift the shingle or to drive in nails, thereby eliminating the risk of broken shingles or roof leaks. The current invention can also be used on metal roofs where penetrating the roof is not a viable option, without attaching anything to the seams of the roof. The current invention is advantageous for working on tile, slate, and cedar roofs, where it is extremely difficult to attach walk boards because slates and tiles must be carefully removed and reinstalled without breaking in the process of walk-board installation. The current invention eliminates the necessity of removing tiles or slates in order to install walk boards.

FIGS. 8-16 illustrate a ridge hook system in accordance with alternative embodiments of the invention. The ridge hook system of FIGS. 8-16 enables a ridge hook to be easily put in position on a roof ridge by a user standing on a ladder at the roof eave. The ridge hook system of FIGS. 8-16 also optionally provides an anchoring mechanism for securely affixing the ridge hook to a roof such that the ridge hook may function as an anchoring point for workers on the roof.

It is known to affix a wheel to the top edge of the straight portion of a ridge hook and to affix a long pole to the proximal (straight) end of a ridge hook to enable a user to roll the ridge hook up a sloped roof to the ridge. To do this, the user must first flip the ridge hook upside down (as compared to its orientation when in place on the ridge) such that the wheel is in contact with the sloped roof, and then flip the ridge hook back over when the ridge hook reaches the ridge. As the user is pushing/rolling the ridge hook up the sloped roof in this upside-down orientation, the center of gravity of the conventional wheeled ridge hook tends to make the ridge hook travel crookedly or even fall over as it is pushed up the slope. Thus, it is difficult to keep the conventional wheeled ridge hook in the necessary upside-down orientation while pushing/rolling the ridge hook up the sloped roof and to ensure that it ends up in the desired location. Users often find it necessary to use two or even three poles to successfully push a conventional wheeled ridge hook up to the ridge. The ridge hook system of FIGS. 8-16 solves this disadvantage of conventional wheeled ridge hooks with novel positioning of the wheels, as described below.

The ridge hook 110 of FIGS. 8-16 comprises a J-shaped main body 112 with a crossbar 114 extending perpendicularly from the curved end of the main body 112. The crossbar 114 comprises two generally cylindrical portions projecting outward on opposing sides of the main body 112. The cylindrical portions of the crossbar 114 may have protective covers 116 to help prevent damage to the roof surface. The protective covers 116 may be constructed of rubber, silicone, or any other suitable material. The protective covers 116 may be removably or non-removably attached to the crossbar 14. At or near the lower end of the ridge hook 110 there may be a foot 120 (shown attached to a lateral bracket 118) to elevate the lower end of the ridge hook 110 above the roof surface to help protect the roof surface from damage. The foot 120 may be constructed of rubber, silicone, or any other suitable material. At or near the lower end of the ridge hook 110 a carabiner 122 (or any other suitable attachment mechanism) may be used to selectively attach a cable to the ridge hook 110.

A sleeve 128 is affixed to or integral with the J-shaped main body 112 at or near its proximal (lower) end to enable a positioning pole 140 to be selectively attached to the ridge hook 110. A plurality of spaced apart through-holes 142 are defined in the pole 140 (any suitable number, placement, and spacing of the through-holes 142 may be used). The distal (upper) end of the pole 140 is inserted into the sleeve 128 such that one of the through-holes 142 of the pole 140 aligns with a through-hole (not visible in the figures) defined in the sleeve 128. A lock pin 130 or the like is inserted through the aligned holes to secure the pole 140 to the ridge hook 110.

A handle 144 is selectively attachable to the proximal (lower) end of the pole 140. The handle 144 comprises a hub or sleeve 146 and two handle portions 148 extending perpendicularly from the pole 140 in opposite directions, thereby forming a T-handle. The proximal (lower) end of the pole 140 is inserted into the hub 146 such that one of the through-holes 142 of the pole 140 aligns with a through-hole (not visible in the figures) defined in the hub 146. A lock pin 150 or the like is inserted through the aligned holes to secure the pole 140 to the handle 144.

The handle 144 enables a user to twist and pivot the pole 140 and therefore the ridge hook 110. This twisting and pivoting is useful when the ridge hook 110 has to be pushed/rolled over an obstacle, such as a ridge vent. Twisting and pivoting the ridge hook 110 enables a user to "walk" the wheels 126 (described below) of the ridge hook 110 over the obstacle.

The ridge hook 110 comprises two wheels 126 affixed to the J-shaped bar 112 via a mounting bracket 124. (Alternatively, but less desirably, the wheels could be affixed indirectly to the J-shaped bar by affixing the wheels to the cross-bar.) Advantageously, the wheels 126 are affixed to the curved portion of the J-shaped bar. This novel positioning of the wheels enables a user to push/roll the ridge hook 110 up a sloped roof in a right-side-up orientation, that is, in the orientation the ridge hook 110 will be in when in position on the ridge. Being able to push/roll the ridge hook 110 up the sloped roof in the right-side-up orientation is easier for a user as the user will not need to flip the ridge hook and the ridge hook will not have a tendency to fall over.

Figure 12:
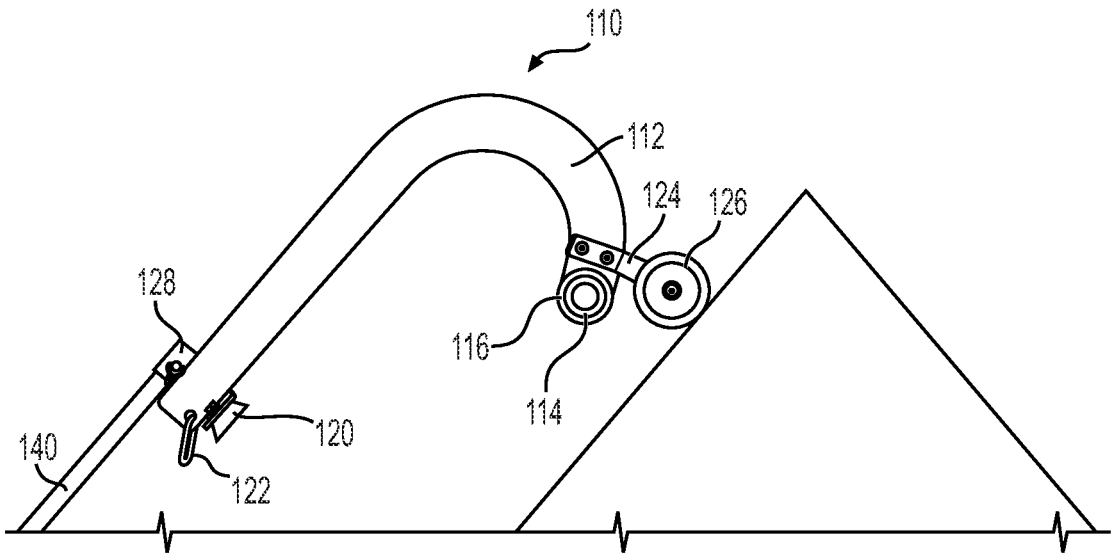
FIGS. 12 and 13 are side views of the ridge hook portion of the system of FIG. 9, showing placement of the device on a roof ridge.
Figure 13:
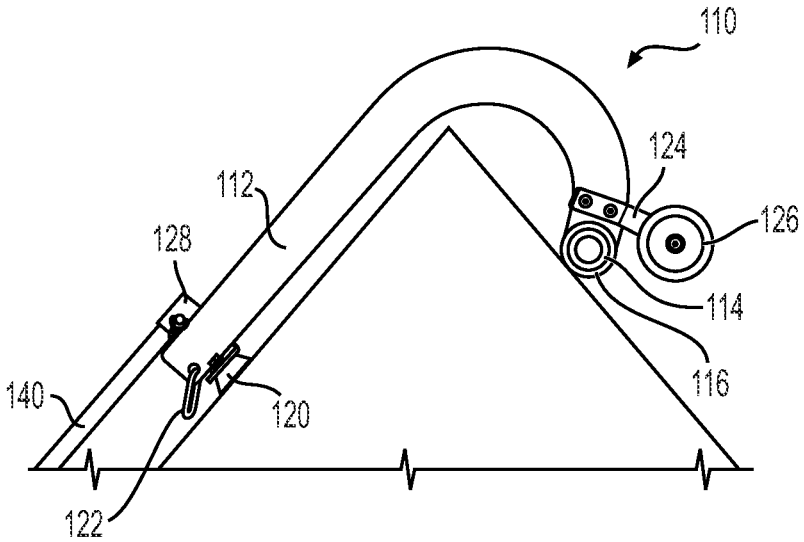

The wheels 126 are attached to the J-shaped bar at a position that is adjacent the cross-bar, that is, in a position that is closer to the distal end than to the straight portion of the J-shaped bar. The wheels 126 are attached to the curved portion of the J-shaped bar 112 at a position such that in a direction perpendicular to the straight portion, the edge of the wheels that is furthest away from the straight portion (indicated by Arrow B in FIG. 11) is further away from the straight portion than is the edge of the cross-bar that is furthest away from the straight portion (indicated by Arrow A in FIG. 11). As seen in FIG. 12, this positioning allows the wheels 126 (but not the cross-bar 114) to contact and roll along the sloped roof as the ridge hook 110 is being pushed/rolled up the sloped roof in the right-side-up orientation. Additionally, in a direction parallel to the straight portion, the edge of the wheels that is closest to the proximal end (indicated by Arrow D in FIG. 11) is further away from the proximal end than is the edge of the cross-bar that is closest to the proximal end (indicated by Arrow C in FIG. 11). As seen in FIG. 13, this positioning allows the cross-bar 114 (but not the wheels 126) to contact the opposite side of the sloped roof when the ridge hook 110 is in position on the ridge.

Figure 14:
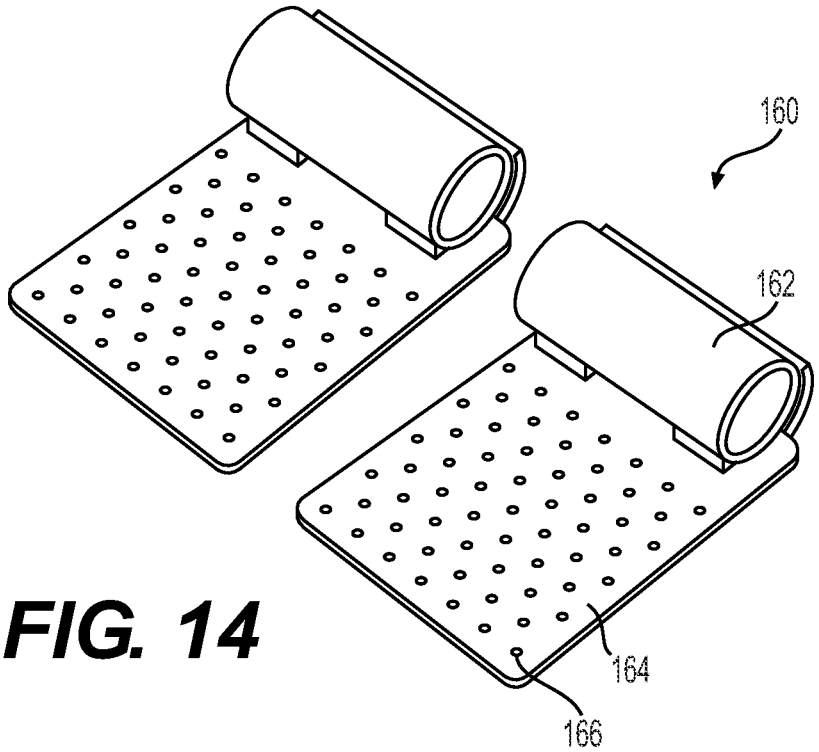
FIG. 14 is a perspective view of an anchor point sleeve for use with the ridge hook portion of the system of FIG. 9.
Figure 15:
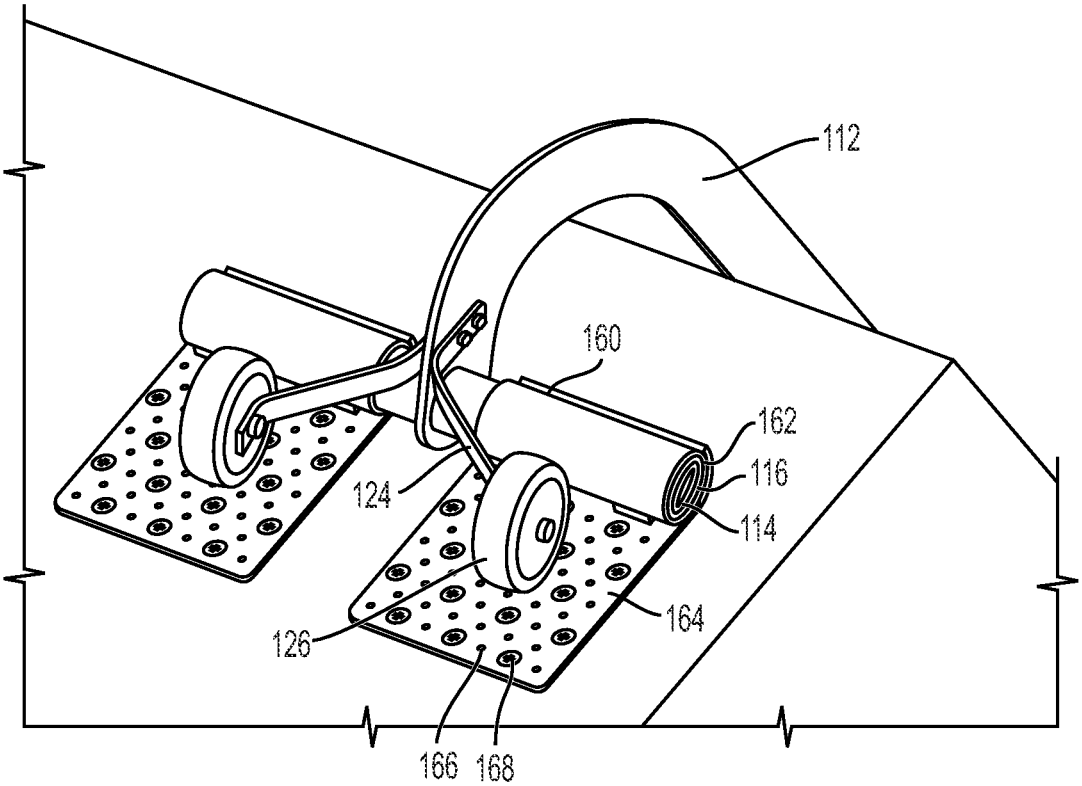
FIGS. 15 and 16 are perspective views of the anchor point sleeve of FIG. 14 in use with the ridge hook portion of the system of FIG. 9.
Figure 16:
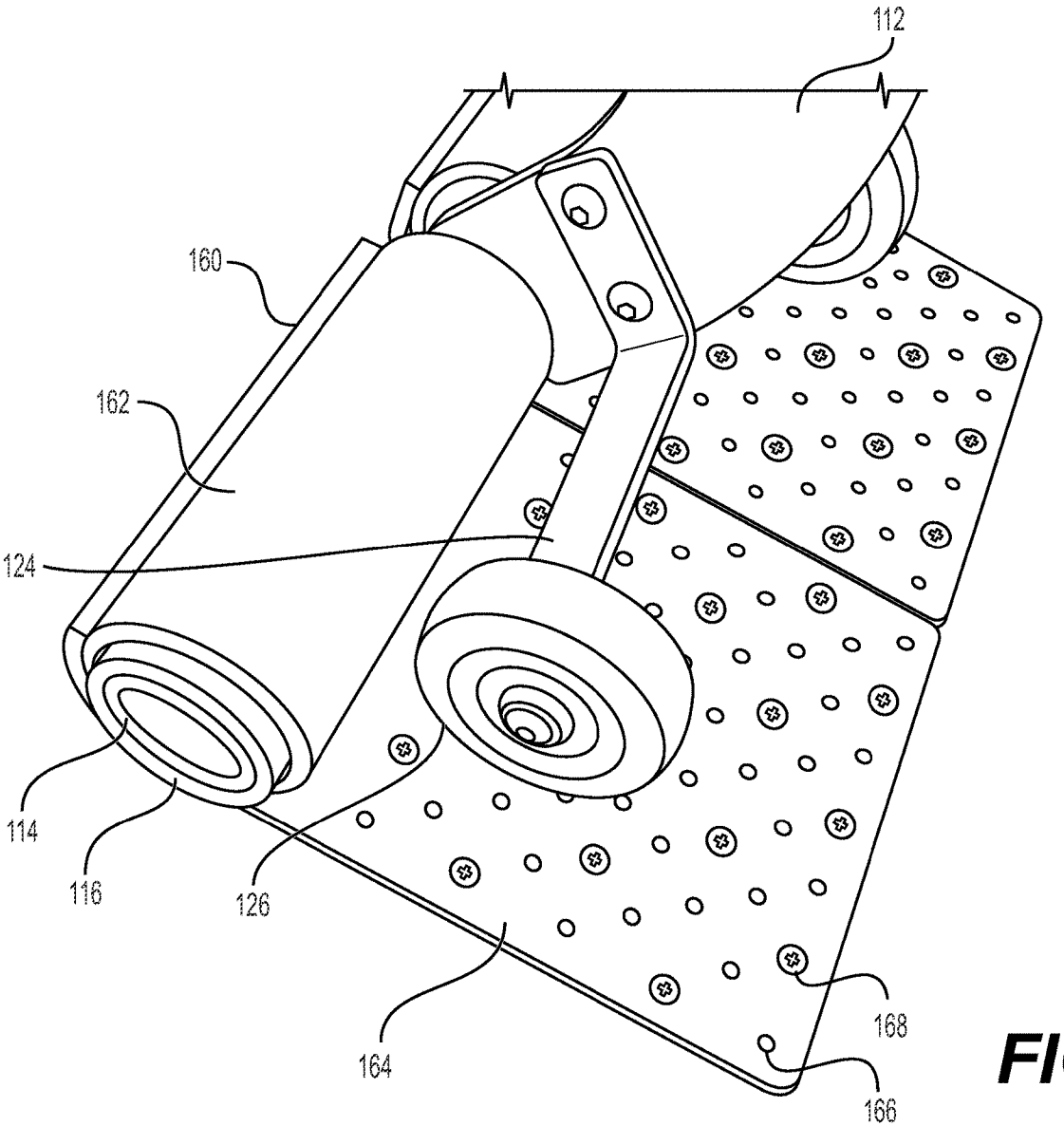

One or more anchoring mechanisms may be removably or non-removably affixed to the crossbar of the ridge hook to enable the ridge hook to be (indirectly) nailed or screwed to the roof surface, thereby providing an OSHA-compliant anchoring point for workers on the roof. It may be desirable or necessary to replace the carabiner 122 with a shackle or the like (not illustrated) for the device to be OSHA-compliant. Any suitable attachment mechanism may be used instead of the carabiner 122. A rope or the like may be attached to the carabiner 122 or other suitable attachment mechanism to assist a worker in climbing the sloped roof and/or to tether the worker. As seen in FIGS. 14-16, such an anchoring mechanism comprises two anchoring plates 160. Each anchoring plate 160 comprises a planar tab 164 having a plurality of holes 166 defined therein and a cylindrical sleeve 162 affixed thereto or integral therewith. As seen in FIGS. 15 and 16, the cylindrical sleeve 162 of each anchoring plate 162 can be slid over a corresponding side of the cross-bar 114. (While the figures show the sleeve 162 slid over both the cylindrical portions of the crossbar 114 and the protective covers 116, it may be desirable to remove the protective covers 116 before sliding the sleeves 162 over the respective cylindrical portions of the crossbar 114.) The planar tabs 164 of each anchoring plate 162 are then secured to the roof via insertion of each of a plurality of screws 168 (or nails, bolts, or the like) through a corresponding one of the plurality of holes 166 and into the roof.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below (if any) are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

That which is claimed:

1. A roof scaffolding support system comprising:

two ridge hooks, each ridge hook comprising (a) a generally J-shaped bar having a proximal end, a straight portion, a curved portion, and a distal end and (b) a cross-bar affixed to or integral with the distal end and perpendicular to the J-shaped bar, each ridge hook adapted to be positioned across a ridge of a roof such that the proximal end is on a first sloped side of the ridge and the distal end is on a second sloped side of the ridge;

two cables, each cable selectively attachable to a corresponding one of the ridge hooks, each cable comprising (a) a main flexible portion having a proximal end and a distal end and (b) a plurality of spaced-apart nodules affixed to or integral with the main flexible portion, each nodule having a dimension perpendicular to a longitudinal axis of the main flexible portion that is larger than a diameter of the main flexible portion; and two roof jacks, each roof jack comprising a base adapted to sit on the first sloped side of the roof and an angled support portion affixed to or integral with the base and adapted to support at least a portion of a scaffolding board;

wherein the base of each roof jack defines a slot having an open end for selectively receiving the main flexible portion of a corresponding one of the cables to selectively secure the base to its corresponding one of the cables;

wherein the slot defined in the base of each roof jack has a width that is (a) greater than the diameter of the main flexible portions of the cables and (b) less than the dimension of the nodules of the cables such that the main flexible portion of each cable can pass through the slot of its corresponding base but the nodules of each cable cannot pass through the slot of its corresponding base, wherein the base of each roof jack further comprises a gate for selectively blocking the open end of the slot to secure the main flexible portion of the corresponding cable in the slot.

2. The system of claim 1, wherein each ridge hook comprises an attachment mechanism to for selectively attaching one of the cables to the proximal end of the corresponding ridge hook.

3. The system of claim 1, wherein each roof jack further comprises two or more feet projecting from an underside of the base such that each base is adapted to sit on the first sloped side of the roof with the underside of the base spaced apart from the first sloped side of the roof at a distance corresponding to a height of the feet.

4. The system of claim 3, wherein the two or more feet of each roof jack comprise two elongated, parallel feet which are adapted to be positioned perpendicular to the roof ridge when the base of each roof jack sits on the first sloped side of the roof.

5. The system of claim 1, wherein each ridge hook comprises one or more wheels affixed to the curved portion of each ridge hook.

6. The system of claim 5, wherein the one or more wheels of each ridge hook are attached to the curved portion of each corresponding ridge hook at a position that is closer to the distal end than to the straight portion of the corresponding ridge hook.

7. The system of claim 5, further comprising two or more elongated poles, each elongated pole selectively attachable to the proximal end of a corresponding ridge hook.

8. The system of claim 7, wherein each elongated pole comprises a handle affixed to or integral with a proximal end of the elongated pole, each handle comprising a first handle portion extending perpendicular to the elongated pole and a second handle portion extending perpendicular to the elongated pole in a direction opposite the first handle portion.

9. A roof scaffolding support system comprising:

two ridge hooks, each ridge hook comprising (a) a generally J-shaped bar having a proximal end, a straight portion, a curved portion, and a distal end and (b) a cross-bar affixed to or integral with the distal end and perpendicular to the J-shaped bar, each ridge hook adapted to be positioned across a ridge of a roof such that the proximal end is on a first sloped side of the ridge and the distal end is on a second sloped side of the ridge;

two cables, each cable selectively attachable to a corresponding one of the ridge hooks, each cable comprising (a) a main flexible portion having a proximal end and a distal end and (b) a plurality of spaced-apart nodules affixed to or integral with the main flexible portion, each nodule having a dimension perpendicular to a longitudinal axis of the main flexible portion that is larger than a diameter of the main flexible portion; and two roof jacks, each roof jack comprising a base adapted to sit on the first sloped side of the roof and an angled support portion affixed to or integral with the base and adapted to support at least a portion of a scaffolding board;

wherein the base of each roof jack defines a slot having an open end for selectively receiving the main flexible portion of a corresponding one of the cables to selectively secure the base to its corresponding one of the cables;

wherein the slot defined in the base of each roof jack has a width that is (a) greater than the diameter of the main flexible portions of the cables and (b) less than the dimension of the nodules of the cables such that the main flexible portion of each cable can pass through the slot of its corresponding base but the nodules of each cable cannot pass through the slot of its corresponding base, wherein each ridge hook comprises one or more wheels affixed to the curved portion of each ridge hook, and wherein the one or more wheels of each ridge hook are attached to the curved portion of each corresponding ridge hook at a position such that (a) in a direction perpendicular to the straight portion, the wheels extend further away from the straight portion than does the cross-bar and (b) in a direction parallel to the straight portion, the wheels are further away from the proximal end than is the cross-bar.

10. A roof scaffolding support system comprising:

two ridge hooks, each ridge hook comprising (a) a generally J-shaped bar having a proximal end, a straight portion, a curved portion, and a distal end and (b) a cross-bar affixed to or integral with the distal end and perpendicular to the J-shaped bar, each ridge hook adapted to be positioned across a ridge of a roof such that the proximal end is on a first sloped side of the ridge and the distal end is on a second sloped side of the ridge;

two cables, each cable selectively attachable to a corresponding one of the ridge hooks, each cable comprising (a) a main flexible portion having a proximal end and a distal end and (b) a plurality of spaced-apart nodules affixed to or integral with the main flexible portion, each nodule having a dimension perpendicular to a longitudinal axis of the main flexible portion that is larger than a diameter of the main flexible portion; and two roof jacks, each roof jack comprising a base adapted to sit on the first sloped side of the roof and an angled support portion affixed to or integral with the base and adapted to support at least a portion of a scaffolding board;

wherein the base of each roof jack defines a slot having an open end for selectively receiving the main flexible portion of a corresponding one of the cables to selectively secure the base to its corresponding one of the cables;

wherein the slot defined in the base of each roof jack has a width that is (a) greater than the diameter of the main flexible portions of the cables and (b) less than the dimension of the nodules of the cables such that the main flexible portion of each cable can pass through the slot of its corresponding base but the nodules of each cable cannot pass through the slot of its corresponding base, wherein each ridge hook comprises one or more wheels affixed to the curved portion of each ridge hook, and wherein the one or more wheels of each ridge hook are attached to the curved portion of each corresponding ridge hook at a position such that (a) in a direction perpendicular to the straight portion, a portion of the wheels that is furthest away from the straight portion is further away from the straight portion than is a portion of the cross-bar that is furthest away from the straight portion and (b) in a direction parallel to the straight portion, a portion of the wheels that is closest to the proximal end is further away from the proximal end than is a portion of the cross-bar that is closest to the proximal end.

11. A method of supporting a scaffolding board on a roof, the method comprising:

positioning two ridge hooks on a ridge of a roof at a distance apart that is less than a length of a scaffolding board, each ridge hook comprising (a) a generally J-shaped bar having a proximal end, a straight portion, a curved portion, and a distal end and (b) a cross-bar affixed to or integral with the distal end and perpendicular to the J-shaped bar, each ridge hook is positioned across the ridge of the roof such that the proximal end is on a first sloped side of the ridge and the distal end is on a second sloped side of the ridge;

connecting each of two cables to a corresponding one of the ridge hooks, each cable comprising (a) a main flexible portion having a proximal end and a distal end and (b) a plurality of spaced-apart nodules affixed to or integral with the main flexible portion, each nodule having a dimension perpendicular to a longitudinal axis of the main flexible portion that is larger than a diameter of the main flexible portion; and positioning two roof jacks on a sloped portion of the roof at a same distance apart as the ridge hooks and at a desired distance from the ridge, each roof jack comprising a base that sits on the sloped portion of the roof and an angled support portion affixed to or integral with the base;

connecting each of the cables to a corresponding one of the two roof jacks; and placing the scaffolding board across the angled support portions of the two roof jacks;

wherein the base of each roof jack defines a slot having an open end that has a width that is (a) greater than the diameter of the main flexible portions of the cables and (b) less than the dimension of the nodules of the cables; and wherein connecting each of the cables to a corresponding one of the roof jacks comprises inserting a main flexible portion of each of the cables into the slot of a corresponding one of the roof jacks, wherein the base of each roof jack further comprises a gate for selectively blocking the open end of the slot to secure the main flexible portion of the corresponding cable in the slot; and wherein the method further comprises closing the gate of each of the roof jacks after inserting the main flexible portion of each of the cables into the slot of a corresponding one of the roof jacks.

12. A roof ridge hook of comprising:

a generally J-shaped bar having a proximal end, a straight portion, a curved portion, and a distal end;

a cross-bar affixed to or integral with the distal end of the J-shaped bar and perpendicular to the J-shaped bar; and one or more wheels affixed to the curved portion of the J-shaped bar;

wherein the ridge hook is adapted to be positioned across a ridge of a roof such that the proximal end is on a first sloped side of the ridge and the distal end is on a second sloped side of the ridge, wherein the one or more wheels are attached to the curved portion of the J-shaped bar at a position such that (a) in a direction perpendicular to the straight portion, the wheels extend further away from the straight portion than does the cross-bar and (b) in a direction parallel to the straight portion, the wheels are further away from the proximal end than is the cross-bar.

13. The roof ridge hook of claim 12, wherein the position to which the one or more wheels are attached to the curved portion of the J-shaped bar is closer to the distal end than to the straight portion of the J-shaped bar.

14. The roof ridge hook of claim 12, further comprising an elongated pole selectively attachable to the proximal end of the J-shaped bar;

wherein the elongated pole comprises a handle affixed to or integral with a proximal end of the elongated pole, each handle comprising a first handle portion extending perpendicular to the elongated pole and a second handle portion extending perpendicular to the elongated pole in a direction opposite the first handle portion.

15. The roof ridge hook of claim 12, further comprising one or more anchoring plates, each anchoring plate comprising a planar tab having a plurality of holes defined therein and a sleeve for selectively receiving at least a portion of the cross-bar;

wherein the planar tab is adapted to be secured to the roof via insertion of each of a plurality of nails, screws, or bolts through a corresponding one of the plurality of holes and into the roof.

16. A roof ridge hook comprising:

a generally J-shaped bar having a proximal end, a straight portion, a curved portion, and a distal end;

a cross-bar affixed to or integral with the distal end of the J-shaped bar and perpendicular to the J-shaped bar; and one or more wheels affixed to the curved portion of the J-shaped bar;

wherein the ridge hook is adapted to be positioned across a ridge of a roof such that the proximal end is on a first sloped side of the ridge and the distal end is on a second sloped side of the ridge, wherein the one or more wheels are attached to the curved portion of the J-shaped bar at a position such that (a) in a direction perpendicular to the straight portion, a portion of the wheels that is furthest away from the straight portion is further away from the straight portion than is a portion of the cross-bar that is furthest away from the straight portion and (b) in a direction parallel to the straight portion, a portion of the wheels that is closest to the proximal end is further away from the proximal end than is a portion of the cross-bar that is closest to the proximal end.

17. A roof ridge hook comprising:

a generally J-shaped bar having a proximal end, a straight portion, a curved portion, and a distal end;

a cross-bar affixed to or integral with the distal end of the J-shaped bar and perpendicular to the J-shaped bar;

one or more wheels affixed to the curved portion of the J-shaped bar;

wherein the ridge hook is adapted to be positioned across a ridge of a roof such that the proximal end is on a first sloped side of the ridge and the distal end is on a second sloped side of the ridge; and one or more anchoring plates, each anchoring plate comprising a planar tab having a plurality of holes defined therein and a sleeve for selectively receiving at least a portion of the cross-bar;

wherein the planar tab is adapted to be secured to the roof via insertion of each of a plurality of nails, screws, or bolts through a corresponding one of the plurality of holes and into the roof, and wherein the cross-bar comprises two cylinders protruding perpendicularly from the J-shaped bar in opposite directions;

wherein the one or more anchoring plates comprises two anchoring plates;

wherein the sleeve of each anchoring plate comprises a cylindrical sleeve;

wherein the cylindrical sleeve of each anchoring plate selectively receives a corresponding one of the two cylinders of the cross-bar.

* * * * *